United States Patent [19]

Yamamoto

[11] Patent Number: 4,743,947

[45] Date of Patent: May 10, 1988

[54] COPYING MACHINE FOR PRODUCING MARGINS OF CONSTANT WIDTH

[75] Inventor: Haruo Yamamoto, Osaka, Japan

[73] Assignee: Mita Industrial Co., Ltd., Osaka, Japan

[21] Appl. No.: 936,481

[22] Filed: Nov. 26, 1986

[30] Foreign Application Priority Data

Nov. 30, 1985 [JP] Japan ..... 60-270469

[51] Int. Cl.[4] ..... G03G 15/00

[52] U.S. Cl. ..... 355/14 R; 355/8; 355/14 SH

[58] Field of Search ..... 355/3 SH, 7, 8, 14 R, 355/14 SH

[56] References Cited

U.S. PATENT DOCUMENTS 4,260,241 4/1981 Honma et al. ..... 355/14 R
4,350,439 9/1982 Tanioka et al. ..... 355/35 SH X

FOREIGN PATENT DOCUMENTS 56-91255 7/1981 Japan ..... 355/7
60-114882 6/1985 Japan .

*Primary Examiner*—A. C. Prescott

*Assistant Examiner*—Pendegrass J.

*Attorney, Agent, or Firm*—Stiefel, Gross & Kurland

[57] ABSTRACT

A copying machine wherein an orginal is exposed to light by the movement of a document table or an optical system to form an electrostatic latent image on a photoconductive drum at an image forming station, and the latent image is developed and then transferred from the drum to copy paper at a transfer station. The machine has a detector for producing an output upon detecting that the optical system has reached a predetermined position subsequent to the starting end of the original during the exposure, a timer for measuring a specified period of time from the time the detector produces the output, and a drive device for initiating a paper transporting device into operation in response to an input from the timer, the distance of transport of the paper from the transporting device to the transfer station being smaller than the distance from the image forming station to the transfer station along the periphery of the drum. A margin of specified width is formed at the leading end of the paper to render the paper transportable through the machine with improved characteristics.

6 Claims, 3 Drawing Sheets

COPYING MACHINE FOR PRODUCING MARGINS OF CONSTANT WIDTH

BACKGROUND OF THE INVENTION

1. Field of the Invention

The present invention relates to an electrophotographic copying machine adapted to produce copies with a margin at the leading end of each sheet of copy paper and give improved transport characteristics to its transport system for the transfer of copy images.

2. Description of the Prior Art

When toner is deposited on the leading end of copy paper, the system for transporting the copy paper fails to exhibit the desired transport characteristics and to transport the copy paper properly, so that conventional copying machines are adapted to intentionally form a minimum margin at the leading end of the copies produced. More specifically, a white plate of specified width is provided at the position where the leading end portion of the original laps over the plate, and the white plate is exposed to light before the original to form the margin at the leading end of the copy paper.

However, when an original is copied with such a copying machine on a reduced or enlarged scale, there arises a problem in that the margin is also reduced or enlarged at the same time. Accordingly, others have attempted to control paper feed timing by detecting the magnification so as to form margins of a constant width even at varying magnifications (see, for example, Unexamined Japanese Patent Publication No. SHO 60-114882).

Nevertheless, the copying machine thus adapted not only requires means for detecting magnifications but also a complex program for computing the timing of the paper feed from the detected magnification and therefore has the problem of being complex in construction and expensive.

The main object of the present invention is to provide a copying machine which is adapted to form margins of a constant width at all times even at varying magnifications merely by control of the paper feed timing with a timer means for measuring a definite set time and which accordingly incorporates simple and inexpensive detecting means and control means.

SUMMARY OF THE INVENTION

The present invention provides a copying machine comprising a document table for placing an original thereon, an optical system movable relative to the document table for exposing the original to light, a photoconductive drum for forming an electrostatic latent image of the original thereon at an image forming station when exposed to an optical image from the optical system, means for developing the electrostatic latent image, means for transporting copy paper to a transfer station, means for transferring the developed image from the photoconductive drum to the copy paper brought into contact with the drum at the transfer station, means for fixing the transferred image to the copy paper, detection means for producing an output upon detecting that the optical system has reached a predetermined position subsequent to the starting end of the original during the exposure of the original, timer means for measuring a specified period of time from the time the detection means produces the output, and a drive means for initiating the paper transporting means into operation in response to an input from the timer means; the distance of transport of the copy paper from the transporting means to the transfer station being smaller than the distance from the image forming station to the transfer station along the periphery of the photoconductive drum.

The specified period of time measured by the timer means is predetermined so that the leading end of the copy paper reaches the transfer station earlier than the forward end of the original image formed on the photoconductive drum.

Preferably, the document table has, at the position where the starting end portion of the original is to be placed, a white plate overlapped by a predetermined area of the starting end portion of the original.

An electric timer, or an electronic timer programmed in a microcomputer is used as the timer means.

A mechanical or optical switch which is operated by the movement of the optical system is used as the detection means.

A motor, or an electromagnetic clutch for transmitting or interrupting the torque to be delivered from the motor is used as the drive means.

DESCRIPTION OF THE PREFERRED EMBODIMENTS

The present invention will be described in detail below as embodied in a copying machine. The invention nevertheless is not limited by the embodiment.

Figure 1:
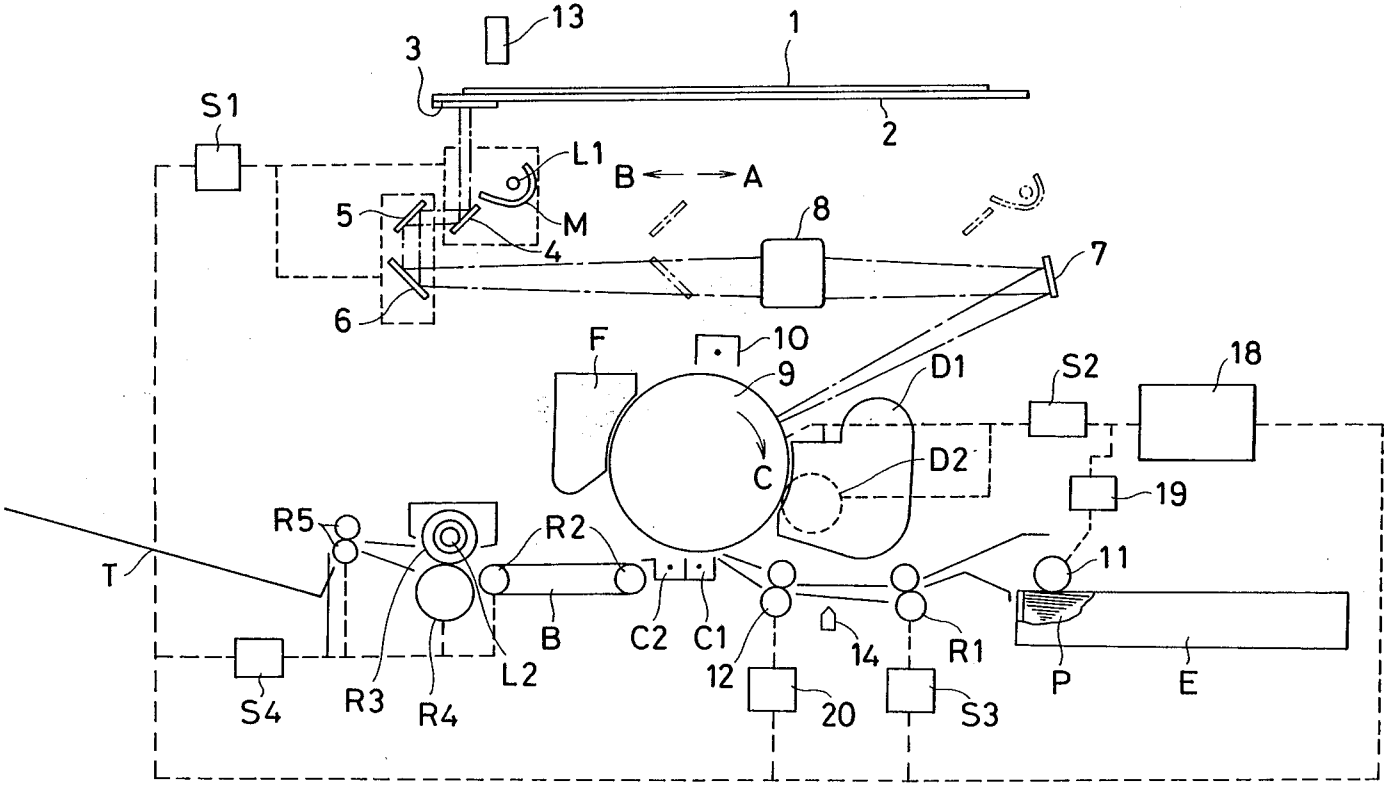
FIG. 1 is a diagram showing the structure of an embodiment of the present invention.

FIG. 1 is a diagram showing the structure of a copying machine embodying the invention. The copying machine includes a document table 2 comprising a transparent glass plate for placing thereon the original 1 to be copied, an exposure lamp L1l for exposing the original 1 to light, a white plate 3 so provided as to be overlapped by the starting end of the original 1, a main reflector M for reflecting the back light of the lamp L1 toward the original 1, a first mirror 4 for reflecting the image light impinging thereon from the original 1, a second mirror 5 for reflecting the light from the first mirror 4, a third mirror 6 for reflecting the light from the second mirror 5, a lens 8 for changing the magnification of the optical image from the mirror 6 to a predetermined value, a fourth mirror 7 for reflecting the light passing through the lens 8, and a photoconductive drum 9 for forming on its surface an electrostatic latent image corresponding to the optical image projected thereon from the fourth mirror 7. The lamp L1, reflector M, mirrors 4, 5, 6, 7 and lens 8 constitute an optical system for forming the optical image of the original 1 on the drum 9. The machine further comprises a main charger 10 for uniformly sensitizing the surface of the drum 9, a developing unit D1 including a developing roller D2 for supplying a developer to the drum 9 and developing the latent image, a cassette E containing copy paper P, a feed roller 11 for delivering the copy paper from the cassette E, a transport roller R1 for transporting the copy paper delivered by the feed roller 11, a resist roller 12 for intermittently feeding the paper toward the drum 9 at a specified time, a transfer charger C1 for charging with corona discharge the rear surface of the paper fed by the resist roller 12 to transfer the developed toner image from the drum 9 onto the front surface of the paper, a separating charger C2 for neutralizing by AC corona discharge the charges on the paper bearing the transferred image to separate the paper from the drum 9, a conveyer belt B driven by rollers R2 for further transporting the separated paper, a pair of fixing rollers R3 and R4 for passing the paper between to heat-fix the toner image, a heat-source lamp L2 housed in the fixing roller R3 for heating the roller R3, discharge rollers R5 for discharging the paper after fixing, a tray T for receiving the discharged paper, a cleaning unit F for cleaning the surface of the drum 9, a main motor 18 for driving components of the copying machine, a forward-reverse electro-magnetic clutch S1 for changeably transmitting the rotation of the motor 18 or interrupting the transmission to move the lamp L1 and the mirror 4 in the direction of arrow A for the exposure of the image-bearing surface of the original 1 to the light from the lamp L1 and to move the same in the direction of arrow B upon completion of the exposure scanning while moving the mirrors 5 and 6 in the same direction as the lamp L1 at one-half the velocity thereof, an electromagnetic clutch S2 for interruptably transmitting the rotation of the motor 18 to the drum 9 and the developing roller D2 to rotate the drum 9 in the direction of arrow C and to rotate the roller D2, a primary paper feed electromagnetic clutch 19 for interruptably transmitting the rotation of the motor 18 to the feed roller 11, an electromagnetic clutch S4 for interruptably transmitting the rotation of the motor 18 to the conveyer belt B, the fixing rollers R3, R4 and the discharge rollers R5, an electromagnetic clutch S3 for interruptably transmitting the rotation of the motor 18 to the transport roller R1, a resist clutch 20 for interruptably transmitting the rotation of the motor 18 to the resist roller 12, a timing switch 13 comprising a microswitch for producing an output upon detecting that the exposure lamp L1 has reached the position for exposing the boundary between the white plate 3 and the original 1 to light while moving in the direction of arrow A for the exposure scanning of the original 1, and a resist switch 14 comprising a microswitch for detecting that the copy paper delivered by the feed roller 11 has reached the resist roller 12.

The copying operation of the machine of the above construction will be described next generally.

By the operation of the motor 18 and the electromagnetic clutch S1; the lamp L1, the main reflector M and the first mirror 4 are moved in the direction of arrow A and then in the direction of arrow B, and with this movement, the second mirror 5 and the third mirror 6 are moved in the same direction. When traveling in the direction of arrow A, the lamp L1 is turned on to illuminate the original 1. The reflected light impinges on the photoconductive drum 9 by way of the first mirror 4, second mirror 5, third mirror 6, lens 8 and fourth mirror 7, projecting an optical image of the original 1 on the surface of the drum 9. The drum 9 is rotated in the direction of arrow C by the operation of the motor 18 and the clutch S2 and is cleaned by the cleaning unit F. An electrostatic latent image is formed on the surface of the drum 9 which is uniformly sensitized by the main charger 10 and on which the optical image of the original 1 is projected. The latent image is converted to a visible image with a developer applied thereto by the developing roller D2 which is rotated by the operation of the motor 18 and the clutch S2. A sheet of copy paper P contained in the cassette E is transported by the feed roller 11 rotated by the operation of the motor 18 and the clutch 19 and by the transport roller R1 rotated by the operation of the clutch S3. Upon the leading end of the paper P reaching the resist roller 12, the resist switch 14 functions to deenergize the clutches S3 and 20, interrupting transport of the paper P. When the resist clutch 20 is energized in timed relation with the progress of development of the drum 9, the paper P is forwarded by the resist roller 12 to the transfer station beneath the drum 9 and is brought into contact therewith, whereupon the paper P is subjected to a discharge on the rear surface thereof by the transfer charger C1. Consequently, the developer forming the visible image on the surface of the drum 9 is transferred to the paper P. The paper P bearing the transferred image is separated from the drum 9 by being subjected to a discharge of the separating charger C2 on its rear surface and is sent to the fixing rollers R3 and R4 by the conveyer belt B. The image is fixed to the paper P by the fixing roller R3 preheated by the heating lamp L2, whereupon the paper is delivered onto the tray T by the discharge rollers R5. Thus, a cycle of a copying operation (process) is completed.

Figure 2:
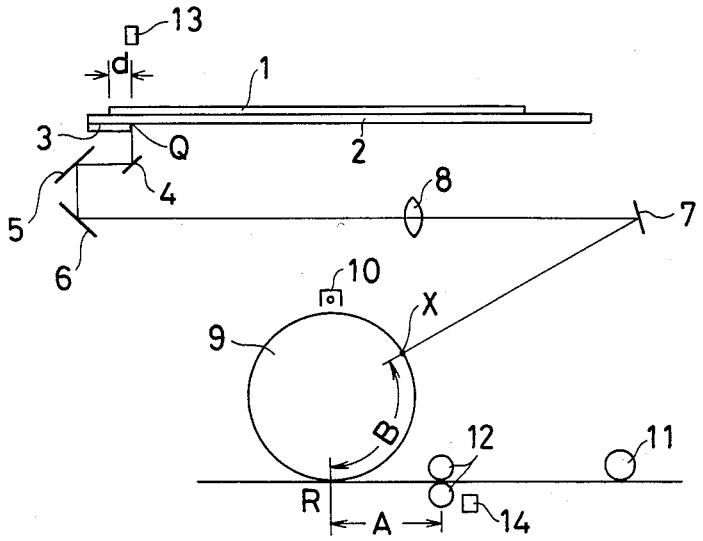
FIG. 2 is a diagram showing the main arrangement of the invention as extracted from FIG. 1.

For a better understanding of the arrangement characteristic of the present invention, FIG. 2 shows the main portion of the arrangement as extracted from FIG. 1. Throughout FIGS. 1 and 2, like parts are designated by like reference numerals.

With reference to FIG. 2, the distance d is the length the original 1 overlaps the white plate 3 when the original 1 is placed on the document table 2. Q represents the boundary between the white plate 3 and the original 1. When the boundary Q is exposed to light by the optical system, the timing switch 13 detects the exposed boundary and produces an output. Further, X represents the position of the image forming station where the optical system forms an image of the original 1 on the drum 9, and R the position of the transfer station where the developed image is transferred from the drum 9 to copy paper. Further A represents the distance of transport of the copy paper from the resist roller 12 to the transfer position R, and B is the distance from the position X to the position R on the periphery of the drum 9. According to the present invention, A is smaller than B.

With reference to the arrangement shown in FIG. 2, the feature of the present invention will be described below briefly.

To transfer the toner image on the drum 9 to copy paper properly, the circumferential speed of the drum 9 is of course made equal to the speed of feed of the copy paper. Since the distance A is smaller than the distance B as mentioned above, it follows that if the resist roller 12 is initiated into rotation when the forward end of image of the original is formed at the position R, the leading end of the copy paper reaches the transfer position R earlier than the forward end of the image. Consequently, a margin corresponding to the time difference is formed at the leading end portion of the copy paper.

It is now assumed that when the resist roller 12 is initiated into rotation a period of time T1 after the production of an output from the timing switch 13, the forward end of the original image is in register with the leading end of the copy paper at the transfer station R.

It is also assumed that the period of time required for the resist roller 12 to transport the copy paper a distance corresponding to the required width of margin is T2. When the resist roller 12 is then initiated into rotation for copying operation a period of time T1−T2 after the production of the output of the timing switch 13, the leading end of the copy paper reaches the transfer station R earlier by the time period T2 than the forward end of the original image formed on the drum 9, so that a margin with a width corresponding to the time period T2 is formed on the paper. Since the speed of transport of the paper by the resist roller 12 is generally constant irrespective of magnifications, the width of margins formed is definite at all times at varying magnifications.

Furthermore, the white plate 3 provided fully eliminates charges from the corresponding latent image forming area on the drum 9, consequently producing a more perfect margin.

Figure 3:
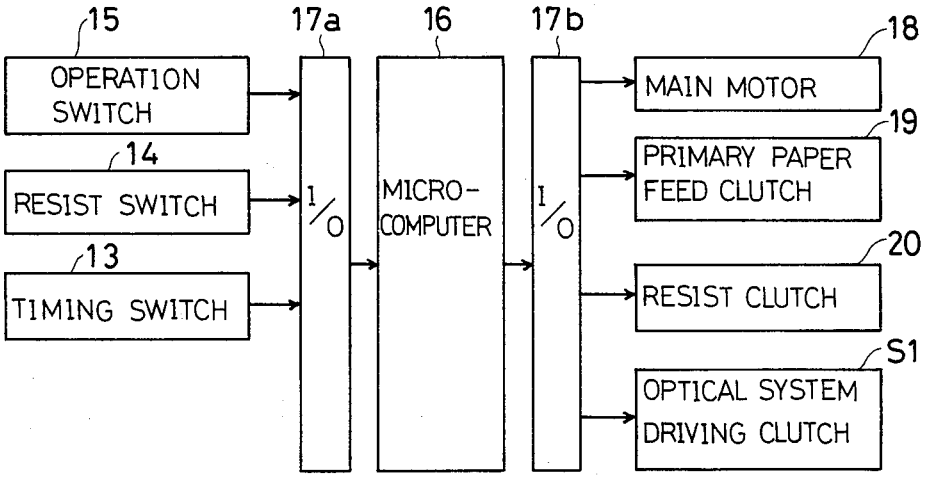
FIG. 3 is a block diagram showing the main control circuit of the embodiment of FIG. 1.

FIG. 3 is a block diagram showing the main portion of the control circuit for the copying machine of FIG. 1. The circuit comprises operation switches 15 including a print key for starting up the machine, a microcomputer 16 incorporating a RAM, ROM, CPU, etc., I/O ports 17*a* through which the microcomputer 16 receives signals from the operation switches 15, resist switch 14 and timing switch 13, the main motor 18 serving as the drive source for the entire copying machine, the primary paper feed clutch 19 for transmitting and interrupting torque from the main motor 18 to the feed roller 11, the resist clutch 20 for transmitting and interrupting torque from the main motor 18 to the resist roller 12, the electromagnetic clutch S1 for driving the optical system, and I/O ports 17*b* for feeding outputs from the microcomputer 16 to the main motor 18, primary paper feed clutch 19, resist clutch 20 and optical system driving clutch S1.

Figure 4:
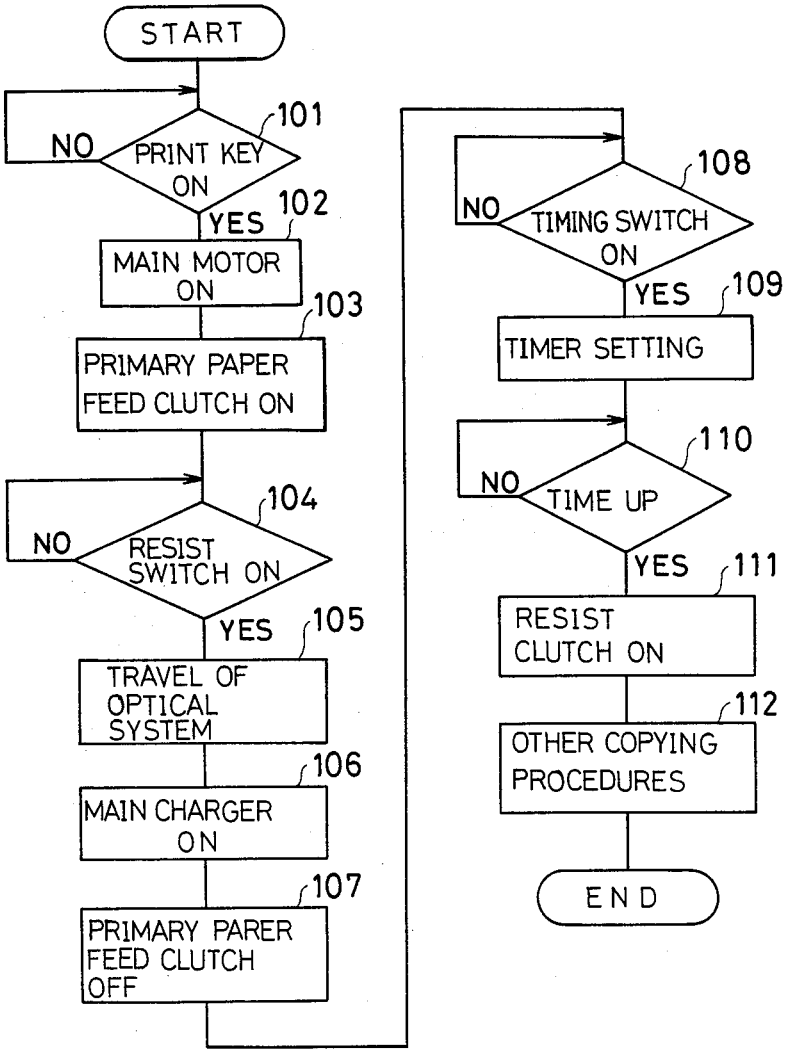
FIG. 4 is a flow chart showing the operation of the main components of the copying machine of FIGS. 1 and 2 and of the control circuit of FIG. 3.

FIG. 4 is a flow chart specifically showing the operation of the main components relating to the invention and included in the copying machine of FIGS. 1 and 2 and in the control circuit of FIG. 3. The operation of the present embodiment will be described below in greater detail with reference to the flow chart. For a simplified description, the distances shown in FIG. 2 are assumed to be as follows: d=2 mm, the distance B from the image forming station X to the transfer station R on the periphery of the drum 9=200 mm, and the distance A from the resist roller 12 to the transfer station R=100 mm. The speed of feed of the paper by the resist roller 12 and the circumferential speed of the drum 9 are both assumed to be 100 mm/sec.

Referring to FIG. 4, when the print key switch 15 is turned on (step 101), the main motor 18 is driven (step 102). Subsequently, the primary paper feed clutch 19 is energized (step 103), whereupon the feed roller 11 is driven to transport copy paper to the resist roller 12. When the resist switch 14 is thereby turned on (step 104), the optical system starts traveling (step 105), the main charger 10 is turned on (step 106), and the feed clutch 19 is deenergized (step 107) to stop the feed roller 11. On the other hand, the photoconductive drum 9 is held in rotation at the circumferential speed of 100 mm/sec by the main motor 18.

When the boundary Q between the white plate 3 and the original 1 shown in FIG. 1 is exposed to light by the traveling optical system with the start of an exposure and formation of an image at the image forming station X, the timing switch 13 is turned on at the same time (step 108), whereupon a timer incorporated in the microcomputer 16 starts measuring time (step 109). The timer is adapted to produce an output upon measuring a period of time of 980 msec. Upon the lapse of the time period 980 msec set on the timer (step 110), the resulting output energizes the resist clutch 20 (step 111) to drive the resist roller 12 and further transport the copy paper. Step 112 then follows for other copying procedures such as transfer and delivery of the paper. It is to be noted that the distance B is 200 mm, with the drum 9 driven at a circumferential speed of 100 mm/sec. Accordingly, the image corresponding to the boundary Q reaches the transfer position R 2000 msec after it is formed at the image forming station, i.e., after the timing switch 13 is turned on. On the other hand, 980 msec after the timing switch 13 is turned on, the copy paper starts traveling at a speed of 100 mm/sec toward the transfer station R which is 100 mm away from the resist roller 12 and requires 1000 msec to reach the transfer position. Consequently, when the image of the original at its starting end (the image corresponding to Q) reaches the transfer position R after the timing switch 13 is turned on, the leading end of the paper has already traveled for 20 msec past the transfer position R, i.e., 2 mm beyond this position.

Owing to the presence of the white plate 3, no toner is deposited on the drum 9 at the area thereof corresponding to the 2-mm-portion of the copy paper, so that a 2-mm-wide margin is formed at the leading end of the paper.

In this way, the image portion corresponding to the white plate 3 shown in FIG. 1 is not produced on the drum 9 and is therefore not formed on the copy paper, giving a margin corresponding to the leading end portion of the paper which has reached the transfer position earlier than the forward end of the original image.

With a change in magnification, the speed of exposure of the original varies, but the feed speed of the paper (equal to the circumferential speed of the drum) remains totally unchanged. This assures that a margin of required definite width can be formed at the leading ends of copy sheets. The distance d shown in FIG. 1 is suitably about 1 to about 5 mm.

According to the present invention, a margin of required definite width can always be formed at the leading ends of copy sheets even at varying magnifications without necessitating a complex program. This consequently assures a reliable copying operation and further assures copy paper of a wider effective copying area.

What is claimed is:

1. A copying machine comprising a document table for placing an original thereon, a photoconductive drum, an optical system movable relative to the document table for exposing the original to light to form an electrostatic latent image of the original in variable magnification on the drum at an image forming station, a white color member attached to the table for covering the leading end portion of the original from the exposing light, means for developing the latent image, means for transporting copy paper to a transfer station, means for transferring the developed image from the photoconductive drum to the copy paper brought into contact with the drum at the transfer station, means for fixing the transferred image to the copy paper, detection means for producing an output upon detecting that the boundary between the white color member and the original has been exposed to light by the optical system, timer means for measuring a specified period of time from the time the detection means produces the output and drive means for initiating the paper transporting means into operation in response to an input from the timer means, the distance of transport of the copy paper from the transporting means to the transfer station being smaller than the distance from the image forming station to the transfer station along the periphery of the photoconductive drum and the total period of time ($t_1$), which is the time measured by the timer plus the time to transport the copy paper from the transporting means to the transfer station, being shorter than the period of time for rotating the drum from the image forming station to the transfer station ($t_2$), the difference between $t_1$ and $t_2$ resulting in the formation of a margin on the copy paper, whereby a margin of constant width is formed without readjusting the feed timing of the copy paper even if the copy magnification is varied.

2. A copying machine as defined in claim 1 wherein the specified period of time to be measured by the timer means is so predetermined that the leading end of the copy paper reaches the transfer station earlier than the forward end of the original image formed on the photoconductive drum.

3. A copying machine as defined in claim 2 wherein the document table has at the position where the starting end portion of the original is to be placed a white plate so provided as to be overlapped by a predetermined area of the starting end portion of the original.

4. A copying machine as defined in claim 1 wherein the timer means is an electronic timer programmed in a microcomputer.

5. A copying machine as defined in claim 1 wherein the detection means is a mechanical or optical switch operable by the movement of the optical system.

6. A copying machine as defined in claim 1 wherein the drive means is a motor for producing a mechanical output which is transmitted or interrupted by an electromagnetic clutch.

* * * * *